United States Patent [19]

Greb et al.

[11] Patent Number: 4,829,640

[45] Date of Patent: May 16, 1989

[54] YARN TEXTURING NOZZLE

[75] Inventors: Manfred Greb, Huckeswagen; Rainer Keuth, Remscheid, both of Fed. Rep. of Germany

[73] Assignee: Barmag AG, Remscheid, Fed. Rep. of Germany

[21] Appl. No.: 84,920

[22] Filed: Aug. 13, 1987

[30] Foreign Application Priority Data

Aug. 13, 1986 [DE] Fed. Rep. of Germany ..... 3627513

[51] Int. Cl.[4] ..... D02G 1/12

[52] U.S. Cl. ..... 28/255; 28/272

[58] Field of Search ..... 28/255, 272; 68/5 E

[56] References Cited

U.S. PATENT DOCUMENTS

| | | | |
|---|---|---|---|
| 3,261,071 | 7/1966 | Clendening, Jr. et al. | 28/272 |
| 3,324,526 | 6/1967 | Burns et al. | 28/272 X |
| 4,453,298 | 6/1984 | Nabulon et al. . | |
| 4,529,378 | 7/1985 | Runkel et al. | 28/272 X |
| 4,560,347 | 12/1985 | Runkel et al. | 28/272 X |
| 4,565,524 | 1/1986 | Runkel et al. | 28/272 X |
| 4,641,504 | 2/1987 | Runkel et al. | 28/272 X |
| 4,691,947 | 9/1987 | Burkhardt et al. . | |

FOREIGN PATENT DOCUMENTS

| | | | |
|---|---|---|---|
| 0108205 | 5/1984 | European Pat. Off. | 28/255 |
| 0184625 | 6/1986 | European Pat. Off. . | |
| 0189099 | 7/1986 | European Pat. Off. | 28/255 |
| 62-69866 | 3/1967 | Japan | 28/272 |

*Primary Examiner*—Robert R. Mackey

*Attorney, Agent, or Firm*—Bell, Seltzer, Park & Gibson

[57] ABSTRACT

A yarn texturizing nozzle is disclosed which has two confronting sections that are separable along a separating plane projecting through and longitudinally of a yarn duct that extends through the nozzle and that is supplied with a pressurized fluid such as hot air. A piston within a cavity of one of the nozzle sections is biased by the pressure of fluid within such cavity into abutting engagement with the confronting surface of the other of the nozzle sections. The piston is so designed as to deform, under the force of such engagement, sufficiently as to conform to any unevenness of the confronting surface of the other nozzle section, and so as to minimize fluid leakage at the interface of the nozzle sections.

18 Claims, 4 Drawing Sheets

YARN TEXTURING NOZZLE

FIELD OF THE INVENTION

This invention relates to yarn texturing nozzles of the type having a yarn duct within which an advancing yarn is engaged by a heated pressurized fluid such as hot air or steam. The invention more specifically relates to such a nozzle having two sections that are separable from each other along a separating plane which intersects and extends longitudinally of the yarn duct.

BACKGROUND OF THE INVENTION

Nozzles of the aforesaid type are widely used for texturing synthetic man-made yarn while the same is advanced at a high constant speed. The nozzles may and frequently do include stuffer boxes that receive the advancing yarn following passage thereof from the output end of the yarn duct within the nozzle. The sectional construction of the nozzle facilitates initial threading-up thereof. During each threading-up operation, the nozzle is "opened" by moving one of its sections away from the other of its sections. This permits convenient lateral insertion of the advancing yarn into the then separated yarn duct. Following insertion of the yarn into the duct, the normal abutting relationship between the nozzle sections is reestablished and retained during yarn-texturing operation of the nozzle.

Leakage of the hot air or other heated fluid from the yarn duct desirably should not occur during the yarn-texturing operation of the nozzle. However, in the prior-art nozzle constructions, significant leakage does occur at the juncture or interface between the abutting nozzle-section surfaces containing the yarn duct. The leakage will occur when there is significant unevenness of one or both of the aforesaid surfaces. Such leakage producing unevenness may be the result of improper finishing of the surfaces during manufacture of the nozzle sections. It may also result from warping of one or both of the surfaces, even when they were properly finished during manufacture, occurring when they are exposed to the heated fluid during operation of the nozzle.

Irrespective of its cause, leakage of the fluid from the nozzle during operation is highly undesirable, and a primary object of the present invention is elimination or at least minimization of the leakage problem.

SUMMARY OF THE INVENTION

With the foregoing in mind, the present invention greatly reduces if not altogether eliminates leakage of heated fluid from the yarn duct of a yarn texturizing nozzle of the type having relatively movable abutting sections upon opposite sides of a separating plane that intersects and extends longitudinally of the yarn duct.

More particularly, one of the nozzle sections of the present invention has a cavity which confronts and opens in the direction of the separating plane, and which extends over a substantial portion of the length and width of the other section of the nozzle. The one nozzle section also has means for introducing into the cavity pressurized fluid which may be and preferably is of the same type introduced into the yarn duct of the nozzle. Deformable piston means is mounted in the cavity for movement, in response to the pressure of the fluid within the cavity, into abutting relatinship with the confronting surface portion of the other of the nozzle sections. Even if such surfaces are uneven due to improper manufacture and/or heat warping, leakage is minimized or entirely eliminated by the conformity thereto of the deformable piston means.

In a preferred embodiment of the invention, the front surface of the main body of the piston means contains a groove of semi-circular cross-sectional shape, which groove forms half of the yarn duct of the nozzle. Due to the presence of this groove, and also the desirability of providing the piston body with significant heat capacity, the piston body must have a significant thickness. The body is rendered deformable, notwithstanding its aforesaid thickness, by the presence of a plurality of grooves within the opposite or rear side thereof that is exposed to the pressure of the pressurized fluid within the cavity containing the piston. The grooves include at least first ones that extend parallel to each other and substantially perpendicularly to the length direction of the piston body and to the direction of the advancing yarn. These transverse grooves enable the piston body to flex or bend substantially freely in a longitudinal direction. When flexibility of the piston body in the transverse direction is also desired, its rear face is also provided with grooves that extend longitudinally thereof and parallel to the direction of the advancing yarn within the yarn duct.

The means employed to effet a seal between the side edges of the piston body and the adjacent surfaces of the cavity within which the piston is movable, should be of a type that does not adversely affect the flexiblity of the piston body. With the foregoing in mind, the rear surface of the piston body, which is the one exposed to the pressure fluid within the piston cavity, preferably is overlaid by a flexible member which may take the form of a membrane or thin plate. The flexible member has substantially the same shape and size as the cross-sectional shape of the piston cavity. The sealing means may and preferably does further include a sealing ring which overlies the juncture between the peripheral edges of the flexible sealing member and the cavity surfaces. To ensure that the sealing ring maintains its desired position even when pressurized fluid is not present within the piston chamber, it may be and preferably is supported within a recess of a supporting member also mounted within, and having dimensions slightly less than those of, the piston chamber. The sealing ring and supporting member are movable in unison with the piston.

As an alternative to the use of a thin plate to effect the seal, the piston may be also provided with a cup-shaped membrane, which lies with its cup bottom on the piston and rests with its side edges against the side walls of the cavity. To protect this membrane, which is preferably made of rubber or other suitable elastic material, a protective thin plate may be placed between the piston and the cup bottom, and so as to not effect the deformability of the piston.

The nozzle of the invention may include a stuffer box that receives the advancing yarn exiting from the yarn duct and that forms it into a compressed yarn plug. When the stuffer box is provided, it too should be and is comprised of two sections that are disposed in confronting relationship to each other on opposite sides of the separating plane and that may be moved apart so as to permit insertion of the advancing yarn within the stuffer box, as well as within the yarn duct of the nozzle. One section of the stuffer box in integral with or firmly connected to the piston less one of the nozzle sections, while the other section of the stuffer box is integral with or fixedly connected to the piston body of the other nozzle section.

The stuffer box customarily has relatively thin perforated wall from which the pressurized fluid can readily escape. To strengthen the stuffer box, the movable nozzle section may and preferably does have an extension which extends parallel to the stuffer box and has a resilient member which engages and exerts a biasing force upon the free end of the movable stuffer box section.

As will be understood, the operation of the stuffer box must accommodate the fact that the texturing nozzle must be opened for inserting a yarn. To this end, one nozzle section may include a guide member having a longitudinal cavity along the separating plane and which receives the piston. For the purpose of inserting the yarn, one of the nozzle sections may be mounted so as to be movable perpendicularly to the separating plane. An alternative is to mount one of the nozzle sections for movement in a direction parallel to the separating plane, and still another alternative is to mount one of the nozzle sections on the free end of a swivel arm having an axis of rotation which lies in an extension of the separating plane and so that the nozzle is opened by a rotating motion. After inserting the yarn, the nozzle sections are closed and resiliently pressed against each other. The deformable piston in the cavity of the one nozzle section then serves to seal the nozzle and the yarn duct.

For the simultaneous treatment of two yarns with two texturing nozzles or for the simulteneous treatment of two pairs of yarn by two pairs of texturing nozzles, two swivel arms may be provided and which have a common axis of rotation, but are arranged one below the other in the direction of the advancing yarn. The swivel arms may be of different lengths, and each accommodates at its end one or a pair of texturing nozzles. The longer swivel arm may be rotated independently of the shorter arm for opening its texturing nozzles.

DESCRIPTION OF THE DRAWINGS

Other features of the invention will be apparent from the following description of illustrative embodiments thereof, which should be read in conjunction with the accompanying drawings, in which.

DESCRIPTION OF THE PREFERRED EMBODIMENTS

Figure 1:
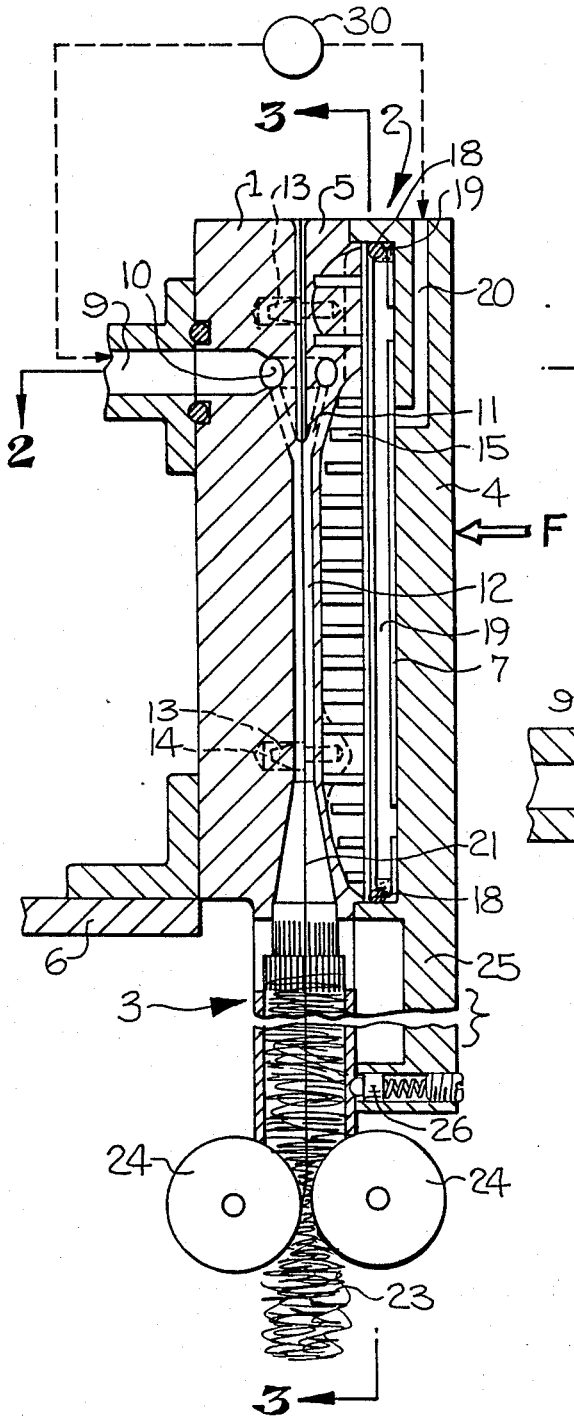
FIG. 1 is a longitudinal sectional view of a yarn texturing nozzle in accordance with the invention, and of a schematically indicated source of pressurized fluid for such nozzle.

The yarn texturing nozzle shown in FIG. 1 of the drawings has a yarn duct 12 that extends vertically through its upper portion and leads to a stuffer box 3 within the lower nozzle portion. Downwardly advancing yarn (not shown) extending through yarn duct 12 is subjected to the force of pressuzized fluid, such as hot air or steam, conduted to the duct from a suitable source 30 via a horizontal passageway 9, an annular passageway 10, and downwardly inclined passageways 11 within the upper portion of the nozzle. The fluid heats and advances the yarn within duct 12 and, at the lower end of the duct, is discharged through slots 22 within the walls of stuffer box 3. The yarn exiting from duct 12 forms a compressed plug 23 which is withdrawn from the stuffer box by feed rolls 24.

The nozzle is comprised of two separable sections 1, 2 that are disposed upon opposite left and right (as viewed in FIG. 1) sides of a separating plane 21 that intersects and extends longitudinally of yarn duct 12 and stuffer box 3. The left section 1, which is fixedly connected to and supported by a stationary frame member 6, contains passageway 9, and approximately half of the passageways 10, 11. Nozzle section 1 also contains a vertically extending groove of semi-circular cross-sectional shape (best shown in FIG. 2), which opens from the right surface of section 1 and defines one-half of yarn duct 12.

The other (rightward, as viewed in FIGS. 1 and 2) nozzle section 2 has a main body 4 containing a chamber or cavity 7 and a passageway 20 connecting such cavity with a source of pressurized fluid. The fluid source illustratively and preferably is the same source 30 as supplies pressurized fluid to yarn duct 12. Cavity 7 spans most of the length or height dimension of body 4 and opens from the left side thereof that confronts separating plane 21 and nozzle secton 1.

A piston means is mounted within cavity 7 for movement relative to it, under the impetus of the pressurized fluid introduced into the cavity through passageway 20, toward separating plane 21 and into abutting engagement with that central portion of the confronting right surface of nozzle section 1 which contains portions of yarn duct 12 and the passageways by which presurized fluid is supplied to such duct. The aforesaid piston means includes a deformable piston body 5 whose front or left (as viewed in FIGS. 1 and 2) surface abuts the aforesaid confronting surface of nozzle section 1, and contains a groove and passageways respectively defining the remaining portions of yarn duct 12 and passageways 10, 11. Tapered pins 13 upon piston 5 are closely (but slidably) received within bores 14 in the right surface of nozzle section 1 to assure proper alignment between the left and right portions of duct 12 and passageways 10, 11.

Cooperating shoulders upon opposite sides of piston 5 and upon a retainer member 8, which is secured in any suitable manner to main body 4 of nozzle section 2, permit limited free movement of the piston body perpendicular to the separating plane 21, while ensuring that the piston remains connected to body 4.

Figure 2:
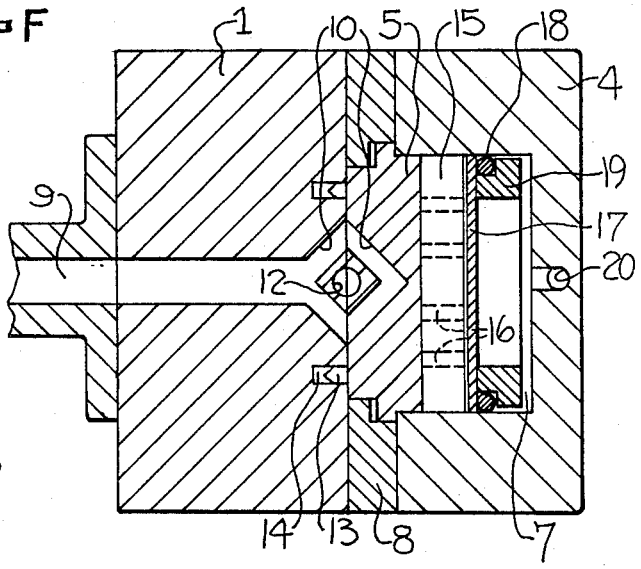
FIG. 2 is an enlarged transverse section taken approximately along the line 2—2 through the nozzle of FIG. 1.
Figure 3:
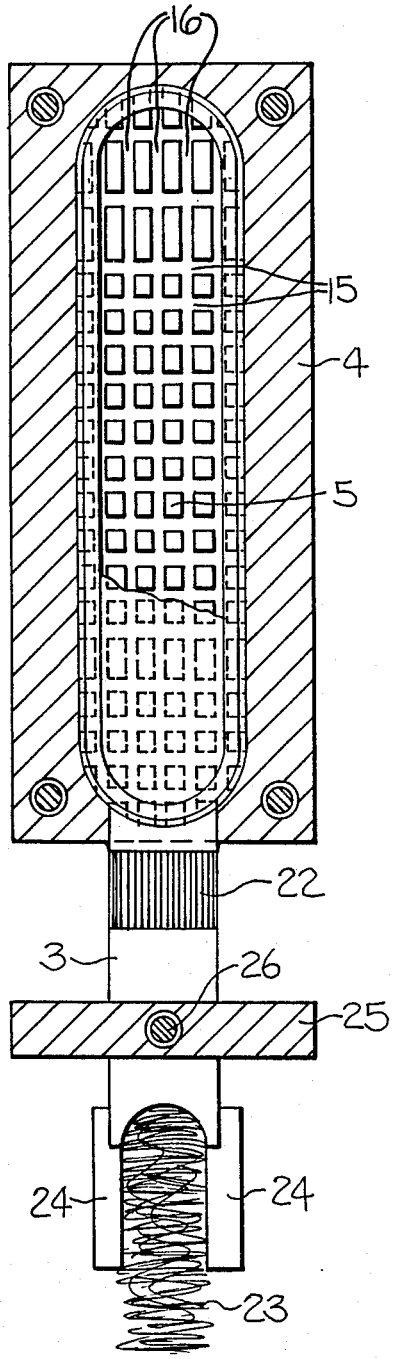
FIG. 3 is a partially sectional and partially elevational view, taken substantially along the line 3—3 of FIG. 1 and showing the rear of the piston means, one component of which is partially broken away.
Figure 4:
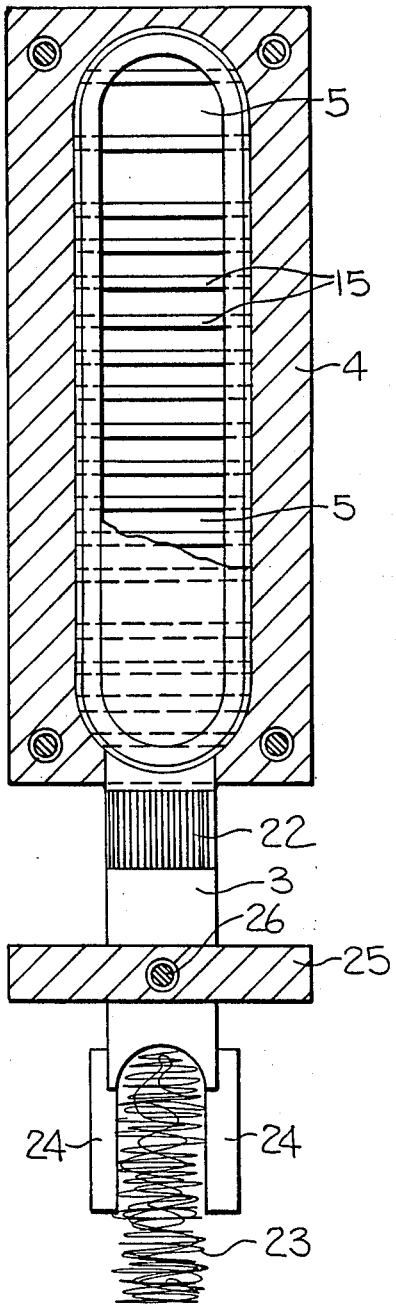
FIG. 4 is a view similar to FIG. 3 showing another embodiment of the piston means.

Under the fluid-pressure induced force of its engagement with the confronting right surface of nozzle section 1, piston 5 undergoes deformation that causes it to confrom to any unevenness that might exist in the aforesaid surface. As previously noted, such unevenness might result from improper manufacture and/or from warping of the surface when it is heated by the fluid conducted to the nozzle during operation thereof. The desired capability of piston 5 for deformation under pressure-induced loading is attributable in significant part to the provision upon its rear (right, as viewed in FIGS. 1 and 2) face of a plurality of transversely extending grooves or slots 15 and longitudinally extending grooves or slots 16. The transverse slots 15 impart flexibility and deformability to piston 5 in the longitudinal direction thereof, which may in some instances be all that is requred. The longitudinal slots 16 are also provided when flexibility and deformability of piston 5 in the transverse direction is also desired. FIGS. 2 and 3 show piston 5 with both types of slots 15, 16, while in FIG. 4 the piston has only the transverse slots 15.

Sealing means are provided to prevent or at least minimize escape of the pressurized fluid within the rear portion of cavity 7 through the spaces between the sides of piston 5 and the thereto adjacent side wall surfaces of the cavity. The aforesaid sealing means includes a thin flexible member 17, such as a membrane or foil-like plate, that overlies the sloted rear face of piston body 5 and that has a size and shape corresponding substantially to the cross-sectional size and shape of cavity 7, so that the edge portions of the member 17 engage the side wall surfaces of the cavity 7. The sealing means further includes a resilient sealing ring 18 that extends about the juncture of the edge portions of sealing member 17 and the adjacent side wall surfaces of cavity 7. To ensure that sealing ring 18 will retain its aforesaid desired position, even at those times when no pressurized fluid is present within cavity 7, it is supportively engaged by a supporting frame 19 disposed within the rear portion of cavity 7. The sealing ring 18 is received within a peripheral recess or notch of frame 19, and projects therefrom so as to simultaneously engage both the peripheral edge of flexible member 17 and the thereto adjacent side wall surfaces of cavity 7.

The movable nozzle section 2 may be resiliently pressed against the fixed section 1 by any suitable biasing means, as schematically indicated by the arrow F in FIG. 1.

The movable right-hand (as viewed in FIG. 1) half of stuffer box 3 is integral with and depends from the lower end portion of piston 5 of nozzle section 2. Firm engagement of the two halves of stuffer box 3 with each other is ensured by the provision, upon a downwardly projecting extension 25 of body 4 of the nozzle section 2, of a spring-type biasing means 26 that urges the movable right half of stuffer box 3 into engagement with the stationary left half of it.

At those times when an advancing yarn is to be inserted into the nozzle, nozzle section 2 is moved away from nozzle section 1. If desired, the suply of pressurized fluid to the nozzle sections may simultaneously be interrupted or reduced. Following movement of the yarn between the separated sections 1, 2 and into the openings defining yarn duct 12 and stuffer box 3, the nozzle sections are moved back into engagement with each other, and full fluid flow to the nozzle sections is resumed, if previously interrupted. The pressure of the fluid introduced via passageway 20 into cavity 7 displaces piston 5 into firm abutting engagement with the confronting surface of nozzle section 1. Since such engagement causes piston 5 to deform sufficiently as to conform to any unevenness of the aforesaid surface of nozzle section 1, leakage of fluid from the nozle during then-ensuing operation thereof is eliminated or at least minimized.

While specific embodiments of the invention have been shown and described, this was for purposes of illustration only, and not for puposes of limitation, the scope of the invention being in accordance with the following claims.

We claim:

1. In a nozzle for texturng an advancing yarn with pressurized fluid such as hot air, said nozzle comprising a duct through which the yarn is adapted to advance at high speed, and passageway means for conducting a heated pressurized fluid into said duct during operation of said nozzle, said nozzle further comprising two confronting sections separable along a separating plane extending through and generally longitudinal of said duct, said sections being in abutting relationship with each other during operation of said nozzle while being separable from each other to facilitate insertion of yarn into said duct, the improvement comprising:

one of said nozzle sections having a cavity confronting and opening in the direction of the other of said nozzle sections, with said cavity extending over a substantial portion of the length and width of the other of the nozzle sections, and means for introducing pressurized fluid into said cavity, and piston means mounted in said cavity for movement, in response to the pressure of fluid within said cavity, into abutting relationship with the confronting surface portion of said other of said nozzle sections, said piston means including a piston body and a plurality of parallel grooves which extend into the surface of said piston body distal from said separating plane a substantial distance so as to impart deformability thereto.

2. A nozzle as in claim 1, and further including sealing means for impeding passage of fluid between the periphery of said piston means and thereto adjacent surfaces of said cavity.

3. A nozzle as in claim 1, wherein said grooves extend transversely into the surface of said piston body distal from said separating plane.

4. A nozzle as in claim 3, wherein said piston means further includes additional grooves extending longitudinally into the surface of said piston body distal from said separating plane.

5. A nozzle as in claim 1, wherein said piston means further includes a flexible sealing member overlying the surface of said piston body distal from said separating plane and having edge portions engaging side wall surfaces of said cavity.

6. A nozzle as in claim 5, wherein said flexible sealing member comprises a thin plate, and further including a sealing ring extending about the juncture between said plate edge portions and said side wall surfaces of said cavity.

7. A nozzle as in claim 6, and further including frame means within said cavity for supporting said sealing ring, said frame means having a shape corresponding substantially to the cross-sectional shape of said cavity and having a peripheral recess opeing toward said juncture between said plate and said cavity, said sealing ring being received within said recess.

8. A nozzle as in claim 1, and further including a common pressurized fluid source connected to said passageway means and said means for introducing a pressurized fluid into said cavity.

9. A nozzle as in claim 1, wherein said piston body has a groove of semi-circular cross-section shape extending longitudinally of the surface thereof adjacent said separating plane, said groove defining part of said yarn duct.

10. A nozzle as in claim 1, wherein said nozzle further includes a perforated stuffer box disposed adjacent the outlet end of said yarn duct for receiving and forming a compressed plug from the advancing yarn exiting from said duct, said stuffer box being divided into two halves lying upon opposite sides of said separating plane, one of said stuffer box halves being fixedly connected to one of said nozzle sections, and the other of said stuffer box halves being fixedly connected to the other of said nozzle sections.

11. A nozzle as in claim 1 wherein said passageway means includes a passageway which communicates with said duct in an inclined direction so that the entering fluid tends to advance the yarn along said duct.

12. In a nozzle for texturing an advancing yarn with pressurized fluid such as hot air, said nozzle comprising a duct through which the yarn is adapted to pass at high speed, and passageway means for conducting a heated pressurized fluid into said duct during operation of said nozzle, said nozzle further comprising two confronting sections separable along a separating plane extending through and generally longitudinally of said duct, said sections being in abutting relationship with each other during operation of said nozzle while being separable from each other to facilitate insertion of yarn into said duct, the improvement comprising:

one of said nozzle sections having a cavity confronting and opening in the direction of the other of said nozzle sections, with said cavity extending over a substantial portion of the length and width of the other of the nozzles sections, and means for introducing pressurized fluid into said cavity, and piston means mounted in said cavity for movement, in response to the pressure of fluid within said cavity, into abutting relationship with the confronting surface portion of said other of said nozzle sections, said piston means comprising a piston body and a flexible sealing thin plate overlying the surface of said piston body distal from said separating plane and having edge portions engaging side wall surfaces of said cavity, said piston body being deformable by the pressure of the fluid within said cavity so as to substantially conform to any unevenness of the confronting surface portion of said other of said nozzle sections.

13. A nozzle as in claim 12 further including a sealing ring extending about the juncture between said plate edge portions and said side wall surfaces of said cavity.

14. A nozzle as in claim 13 further including frame means within said cavity for supporting said sealing ring, said frame means having a shape corresponding substantially to the cross-sectional shape of said cavity and having a peripheral recess opening toward said juncture between said plate and said cavity, said sealing ring being received within said recess.

15. A nozzle as in claim 12, and further including a common pressurized fluid source connected to said passageway means and said means for introducing a pressurized fluid into said cavity.

16. A nozzle as in claim 12, wherein said piston body has a groove of semi-circular cross-section shape extending longitudinally of the surface thereof adjacent said separating plane, said groove defining part of said yarn duct.

17. A nozzle as in claim 12, wherein said nozzle further includes a perforated stuffer box disposed adjacent the outlet end of said yarn duct for receivig and forming a compressed plug from the advancing yarn exiting from said duct, said stuffer box being divided into two halves lying upon opposite sides of said separatig plane, one of said stuffer box halves being mounted to said one of said nozzle sections, and the other of said stuffer box halves being mounted to said other of said nozzle sections.

18. In a nozzle for texturing an advancing yarn with pressurized fluid such as hot air, said nozzle comprising a duct through which the yarn is adapted to advance at high speed, and passageway means for conducting a heated pressurized fluid into said duct during operation of said nozzle, said nozzle further comprising two confronting sections separable along a separating plane extending through and generally longitudinally of said duct, said sections being in abutting relationship with each other during operation of said nozzle while being separable from each other to facilitate insertion of yarn into said duct, the improvement comprising:

one of said nozzle sections having a cavity confronting and opening in the direction of the other of said nozzle sections, with said cavity extending over a substantial portion of the length and width of the other of the nozzle sections, and means for introducing pressurized fluid into said cavity, piston means mounted in said cavity for movement, in response to the pressure of fluid within said cavity, into abutting relationship with the confronting surface portion of said other of said nozzle sections, a perforated stuffer box disposed adjacent the outlet end of said yarn duct for receiving and forming a compressed plug from the advancing yarn exiting from said duct, said stuffer box being divided into two halves lying upon opposite sides of said separating plane, with one of said stuffer box halves being fixedly mounted to said piston means, and the other of said stuffer box halves being mounted to said other of said nozzle sections, and said one of the nozzle sections having a downwardly projecting extension, and biasing means carried by the extension for urging the stuffer box halves into firm engagement.

* * * * *